US009132059B2

(12) United States Patent
Derrick

(10) Patent No.: US 9,132,059 B2
(45) Date of Patent: Sep. 15, 2015

(54) METHOD AND APPARATUS TO REWIRE THE BRAIN WITH FINGER MOVEMENTS

(76) Inventor: Patricia Derrick, Las Vegas, NV (US)

( * ) Notice: Subject to any disclaimer, the term of this patent is extended or adjusted under 35 U.S.C. 154(b) by 278 days.

(21) Appl. No.: 11/702,386

(22) Filed: Feb. 6, 2007

(65) Prior Publication Data

US 2007/0282377 A1 Dec. 6, 2007

Related U.S. Application Data

(60) Provisional application No. 60/810,690, filed on Jun. 5, 2006.

(51) Int. Cl.
*A61H 39/00* (2006.01)

(52) U.S. Cl.
CPC ..... *A61H 39/00* (2013.01); *A61H 2205/067* (2013.01)

(58) Field of Classification Search
CPC ..... A61H 7/00; A61H 7/002; A61H 7/003; A61H 7/005; A61H 39/00; A61H 39/04; A61H 2201/0157; A61H 2205/067; G09B 21/00; G09B 21/003; G09B 21/004; A63F 2009/0003; A63F 2009/0004
USPC ..... 601/40, 131, 136, 133, 134, 135; 434/112, 113, 308, 156–178, 317; 237/241; 606/131; 446/147, 149, 151
See application file for complete search history.

(56) References Cited

U.S. PATENT DOCUMENTS

| | | | | | |
|---|---|---|---|---|---|
| D32,933 | S | * | 7/1900 | Feigl | D21/340 |
| 1,477,255 | A | * | 12/1923 | Fritz | 434/159 |
| 2,944,273 | A | * | 7/1960 | Harris | 601/137 |
| 3,266,724 | A | * | 8/1966 | Johnson | 273/139 |
| 3,564,735 | A | * | 2/1971 | Fisher | 434/403 |
| 3,774,319 | A | * | 11/1973 | Sprowls | 434/164 |
| 3,869,813 | A | * | 3/1975 | Hancy | 434/163 |
| 3,873,096 | A | * | 3/1975 | Shoptaugh | 273/156 |
| 3,886,939 | A | * | 6/1975 | Boxer | 604/290 |
| 4,006,541 | A | * | 2/1977 | Miller | 434/308 |
| 4,477,419 | A | * | 10/1984 | Pearce et al. | 423/228 |
| 4,778,392 | A | * | 10/1988 | Mitchell | 434/403 |
| 5,165,897 | A | * | 11/1992 | Johnson | 434/113 |
| 5,516,291 | A | * | 5/1996 | Miyake | 434/164 |
| 5,660,388 | A | * | 8/1997 | Benn | 273/241 |
| 5,833,635 | A | * | 11/1998 | Aboud, Sr. | 601/136 |
| 5,920,977 | A | * | 7/1999 | Wyckoff et al. | 29/558 |
| 6,257,575 | B1 | * | 7/2001 | Ortega | 273/241 |
| 6,669,478 | B2 | * | 12/2003 | Edwards et al. | 434/159 |
| 6,761,611 | B2 | * | 7/2004 | Wood et al. | 446/175 |
| 6,830,454 | B1 | * | 12/2004 | Harris | 434/237 |
| 7,101,345 | B1 | * | 9/2006 | Liu | 601/133 |
| 2002/0030322 | A1 | * | 3/2002 | Connelly | 273/243 |
| 2002/0095839 | A1 | * | 7/2002 | Allen et al. | 40/584 |
| 2003/0034606 | A1 | * | 2/2003 | Jacobs | 273/236 |

(Continued)

OTHER PUBLICATIONS

Tanner, Anne, "The Labyrinth-Exploring a Path," Summer 2002.*
BackyardBrains, "Experiment: How Your Skin Senses." https://backyardbrains.com/experiments/skin.*
http://www.cognifit.com/brain-plasticity-and-cognition, The Brain Plasticity and Cognition, Part 1. Apr. 2011.*

(Continued)

*Primary Examiner* — Justine Yu
*Assistant Examiner* — Timothy Stanis

(57) ABSTRACT

The present invention provides a mechanism for reorganization of the brain through tactile stimulation. A board is provided that has a dual contact path for tracing by the user's fingers. The contact can be continuous or intermittent and the paths can be mazes, labyrinths, spirals or any other design to stimulate the brain.

15 Claims, 13 Drawing Sheets

(56) References Cited

U.S. PATENT DOCUMENTS

| | | | | |
|---|---|---|---|---|
| 2003/0058139 | A1* | 3/2003 | Sakurai | 341/22 |
| 2003/0099920 | A1* | 5/2003 | Edwards et al. | 434/159 |
| 2003/0139113 | A1* | 7/2003 | Wood et al. | 446/175 |
| 2003/0201915 | A1* | 10/2003 | Anderson et al. | 341/22 |
| 2003/0220656 | A1* | 11/2003 | Gartstein et al. | 606/131 |
| 2004/0249322 | A1* | 12/2004 | Cohen | 601/131 |
| 2005/0267389 | A1* | 12/2005 | Antoine | 601/137 |
| 2008/0246735 | A1* | 10/2008 | Reynolds et al. | 345/173 |
| 2010/0003374 | A1* | 1/2010 | Hachmann | 426/104 |

OTHER PUBLICATIONS http://www.leadered.com/pdf/Brain%20Research%20white%20Paper.pdf, How Brain Research Relates to Rigor, Relevance and Relationships. Date: unknown, before Feb. 6, 2007.* http://www.nature.com/nm/journal/v4/n11/full/nm1198 1313.html, Neurogenesis in the Adult Human Hippocampus. Date: before Dec. 1998.* http://www.abacon.com/pinel/hot sept.html, Allyn &Bacon, Neurogenesis in the Adult Human Brain. Date: before Dec. 1999.*

* cited by examiner

METHOD AND APPARATUS TO REWIRE THE BRAIN WITH FINGER MOVEMENTS

This application claims priority of provisional application Ser. No. 60/810,690, that was filed Jun. 5, 2006.

CROSS-REFERENCE TO RELATED APPLICATIONS

This application makes reference to U.S. Provisional Patent Application No. 60/760,412 filed Jan. 20, 2006, the entire disclosure and contents of which is hereby incorporated by reference.

BACKGROUND

1. Field of the Invention

The present invention relates generally to reorganizing the brain synapses, and more particularly, reorganization of the brain by using the nerve receptors on fingertips.

2. Related Art

Johnson '897 discloses a programmable tactile stimulation array system.

In the past few years, an enormous amount of research has revealed that the brain never stops changing and adjusting. Brain plasticity is the ability of the nervous system to adapt to changed circumstances and find new ways of learning, sometimes after an injury or a stroke, but more commonly when acquiring a skill. Professor Thomas Elbert, Professor of Psychology at the University of Konstanz in Germany, conducted experiments with individuals who used Braille. The experiments were conducted to determine whether adult brains have plasticity. The findings showed a super highway from the fingertips to the brain. The fingertips provided a means for the brain to adapt and find new ways of learning (Brain Plasticity, Thomas Elbert, January 1998, Radio National, the Health Report)

Research has found that there appear to be at least two types of modifications that occur in the brain with learning. The first is a change in the internal structure of the neurons, the most notable being in the area of synapses, and the second is an increase in the number of synapses between neurons.

The effects of tactile stimulation on the structure of the brain can be appreciated by understanding that the skin is almost an extension of the brain, formed as it is from the same layer of tissue during the embryonic stage of life (Taylor, 1979: 136). (Biosociology: An Emerging Paradigm, Anthony Walsh, 1995)

As with muscle tone and cardiovascular fitness, a new study suggests that use of the brain is required to prevent loss. The cells and connections that are used will survive and flourish, while cells and connections that are not used will wither and die (Dr. Jay Giedd MD, frontline interviews, PBS)

Scientists theorize that cognitive activities are protective in some way. Some speculate that repetition may improve the efficiency of certain cognitive skills and make them less vulnerable to the brain damage associated with Attention Deficit ("AD") Repetition provides mechanisms that may strengthen information processing skills to help compensate for age-related declines in other cognitive areas.

It is known that repetition forms connections and that with proper stimulation, the synapses become stronger. During use electrical chemicals are sent out that make the connections stronger and more permanent. (Brain Development, Karen DeBord, North Carolina cooperative Extension Service). Wiring the brain: "Synapse additions" are not only sensitive to experience, but are actually driven by experience. The role of experience is essential for not only increasing the initial wiring of the brain during childhood but continues to increases the overall quality of functioning of the brain during an entire lifetime. As cardiovascular exercise increases the channels of flow to and from the heart, learning serves to add synapses throughout the brain. (How People Learn, Brain, Mind, Experience and School, Expanded Edition, 2000, Commission on Behavioral and Social Sciences and Education, Mind and Brain)

BRIEF DESCRIPTION OF THE DRAWINGS

The invention will be described in conjunction with the accompanying drawings, in which.

DETAILED DESCRIPTION

Figure 1:
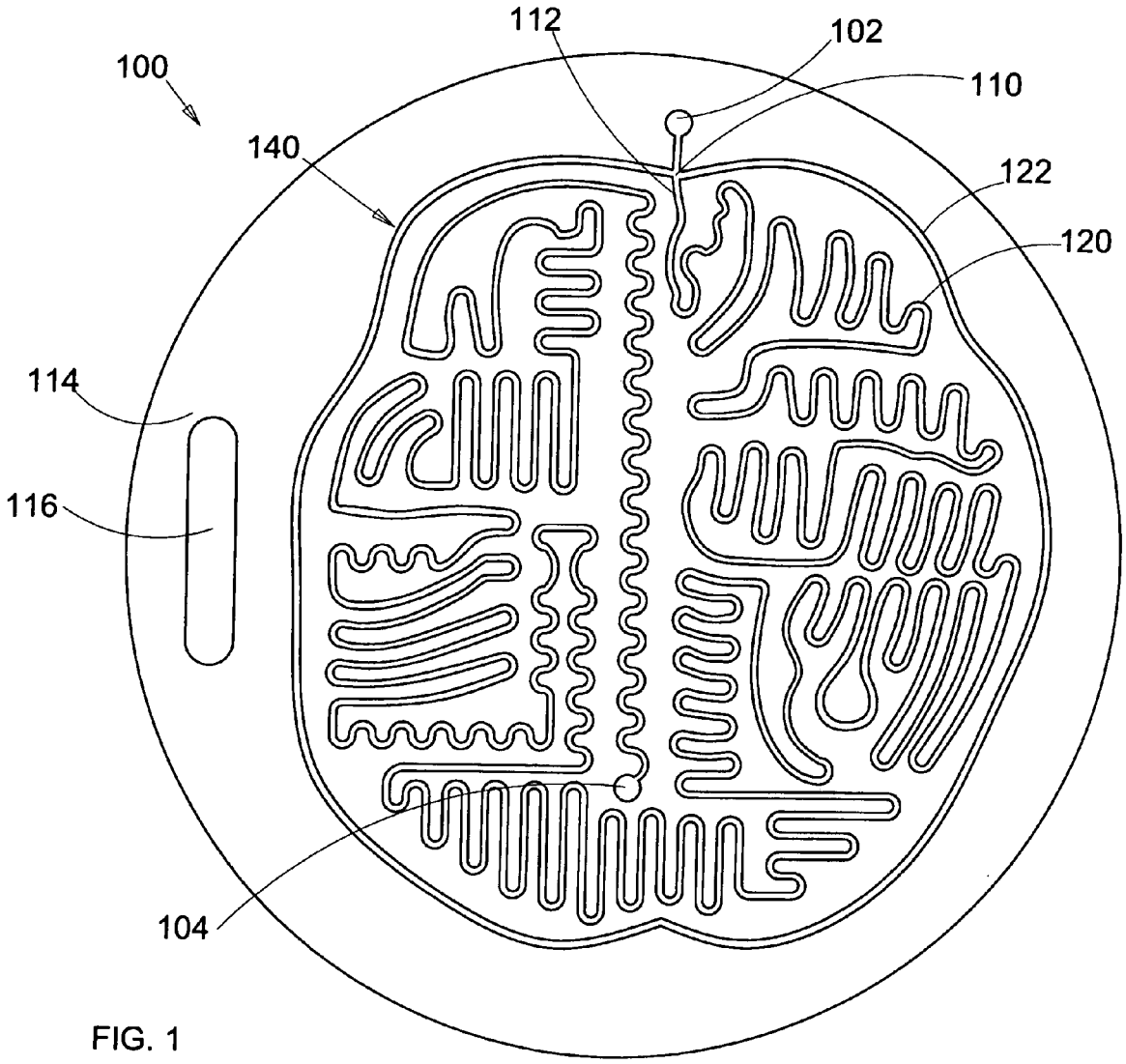
FIG. 1 is a plan view of a brainpath board in accordance with one embodiment of the present invention present invention.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, the term "attention deficit" refers to a persistent pattern of inattention and hyperactivity-impulsivity or both, occurring more frequently and severely than is typical in individuals at a comparable level of development.

For the purposes of the present invention, the term "brainpath board" refers to any object including a surface accessible by a user that includes a brainpath network thereon and/or therein. In addition to being a flat board, "a brainpath board" may be a ball, a cylinder, an irregular surface, etc. The surface including the brainpath surface may be may convex, concave surface, undulating, or any other shape or design that may permit tracing of a brainpath network by a user.

For the purposes of the present invention, the term "brainpath network" refers to the overall design formed by a dual contact path. This path may take the design of a brain, a maze, serpentine, or any other pattern that enables a user to make continuous contact with the dual contact paths.

For the purposes of the present invention, the term "brain plasticity" refers to the idea that healthy brain cells may take up the functions of brain cells that have died or been damaged through learning.

For the purposes of the present invention, the term "dual contact path" refers to the path formed by contact points separated a distance to enable both of the contact points to be touching a user's finger simultaneously.

For the purposes of the present invention, the term "learning" refers to the capability of obtaining new knowledge, or skills, through instruction or experience.

For the purposes of the present invention, the term "memory" refers to the retention of knowledge over time.

For the purposes of the present invention, the term "neuron" refers to the conventional meaning of neuron i.e. a nerve cell.

For the purposes of the present invention, the term "synapse" refers the junction between two adjacent neurons (i.e., between the axon ending of one and a dendrite beginning of the next). At the synapse, the cleft or gap between the two cells is miniscule (twenty to thirty nanometers). Nerve impulses breach this gap with the aid or neurotransmitters. Most neurons have more than one synapse. (The Mind, Richard M. Restake, M.D., Bantam Books, Copyright October 1998)

For the purposes of the present invention, the term "sensory point," or "sensory edge" refers the point of contact between the two contact surfaces that form the network path and the user's fingertip. The sensory point may be solid along the path or intermittent, fully or partially recessed into the base, extend upward, fully or partially, from the based or be a combination thereof.

Description

Touch is bi-directional in that tactile stimuli can be both created and felt through the skin. Although skin is the largest organ in the body in terms of surface area, sensitivity is not uniformly distributed with the highest sensitivity occurring at the fingertips due to the high density of mechanoreceptors.

In order to increase the number connections, or synapses, within the brain, the associated areas must be repeatedly used. Although many types of training, or stimulation, can be used, it has been recognized that through sensory stimulation and repetitious mind exercises resulting from repetitive finger movement, memory may be increased, cognitive abilities improve, and anxiety, depression and stress released. It is also believed that tactile, sensory stimulation may enlarge the brain by assigning more tissue and neural elements. To date, however, the only proven available means for obtaining this repetitive motion tactile stimulation, based upon research studies, have been by: Violin strings, where the fingers are moved along the string; Braille, where moving across the dots stimulate the brain; piano finger tapping, research has proven that fingers tapping stimulate the brain; raised letters where running the finger for recognition of the letter stimulates the brain.

The rewiring of the brain has been termed "reorganization" as researchers are unsure whether this rewiring results from new connections or strengthening of existing connections. Scientists are, however, sure that the adult brain does, to some extent, rewire itself. This finding helps explain how learning occurs and may lead to ways of improving recovery from learning disabilities, stroke, and other brain disorders through drug treatments or special "brain exercises". One example given to develop new connections between brain neurons was learning to read Braille. (Brain Briefings, brain reorganization, Leah Ariniello, Science Writer, Society for Neuroscience, 11 Dupont Circle, NW, Suite 500, Washington D.C., 20036).

In an article regarding research done with stroke patients, Dr. Mike Ridding, of the University of Adelade, noted that "[S]imple finger movement can change the size of the area of motor cortex that controls specific finger muscles, and even alter its neural connections. In blind Braille readers, the cortical area for the reading finger is much larger than for a non-reading finger . . . . By developing a method of stimulating the pathways leading back to the brain from the affected muscles, we may be able to encourage the development and use of an alternative cortical area to that damaged by the stroke." (Rewiring the damaged brain, Monday, 10 Apr. 2000, University of Adelaide, Dr. Mike Ridding).

T. V. Cramer of the International Braille Research Center has stated that "[T]he area of the skin brought in contact with the line of Braille being read has a critical relation to the efficiency with which the tactile information is passed to the brain. This is a variable of the reading strategy of each individual: one finger, two fingers, or more; one hand or two hands. The greater the skin contact with the Braille line, the larger the tactile view." (A Call for Research on Braille Reading and Haptic Perception by T V Cranmer, President International Braille Research Center).

Reorganization of the brain through tactile stimulation may provide a method of assisting patients. Injuries to the brain through stoke or accidents, loss of memory through disease and increased concentration are only a few of the areas where this method of therapy may prove to be helpful.

Alzheimer's disease is a progressive disease with no cure and rising numbers. Alzheimer's creates brain lesions that accumulate in the brains of patients causing brain cells to die; resulting in memory loss, disorientation and a declining ability to handle everyday life. Although state of the art drugs may help to lessen and stabilize the symptoms they do not inhibit the loss of brain tissue. It is believed by researchers even the brains of people with Alzheimer's who are very old may capable of producing new neurons in order to maintain established connections-pathways that encode long-term memories and enable a person to acquire new memories.

Attention Deficit Disorder ("ADD") and Attention Deficit Hyperactive Disorder ("ADHD") is an increasing issue with both children and adults that may be caused by a weakness in how the brain uses neurotransmitters which is generally treated through drugs. As symptoms may lesson in late teenage and early adulthood, it is believed that some people may learn to compensate for the associated symptoms. Research by The KID Foundation's SPD Network, and others, regarding sensory integration therapy are providing data that along with sight, touch, smell, hearing and taste, there are other senses that are important for attention and learning; vestibular (inner ear, affecting movement), proprioceptive (joints, muscles and tendons affecting relationship of the body to "space"); tactile (touch affecting pressure and pain) and praxis (motor planning affecting the organization of sensory information).

Sensory Integration Therapy includes repetitive, organized tactile motions such as taking a brush and firmly executing brush strokes. It is believed that Sensory Integration Therapy works as it provides input (such as sensory) that actually helps to organize the central nervous system. This organization, in turn, theoretically leads to improvements on a functional level.

Figure 2:
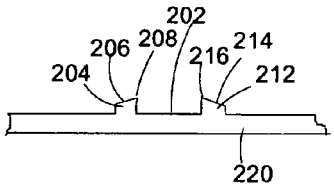
FIG. 2 is a cross-sectional side view of a raised path in accordance with one embodiment of the present invention present invention.
Figure 3:
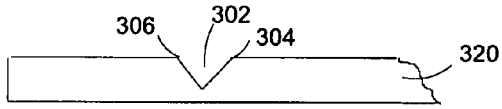
FIG. 3 is a cross-sectional side view of a V-shaped etched path in accordance with one embodiment of the present invention present invention.
Figure 7:
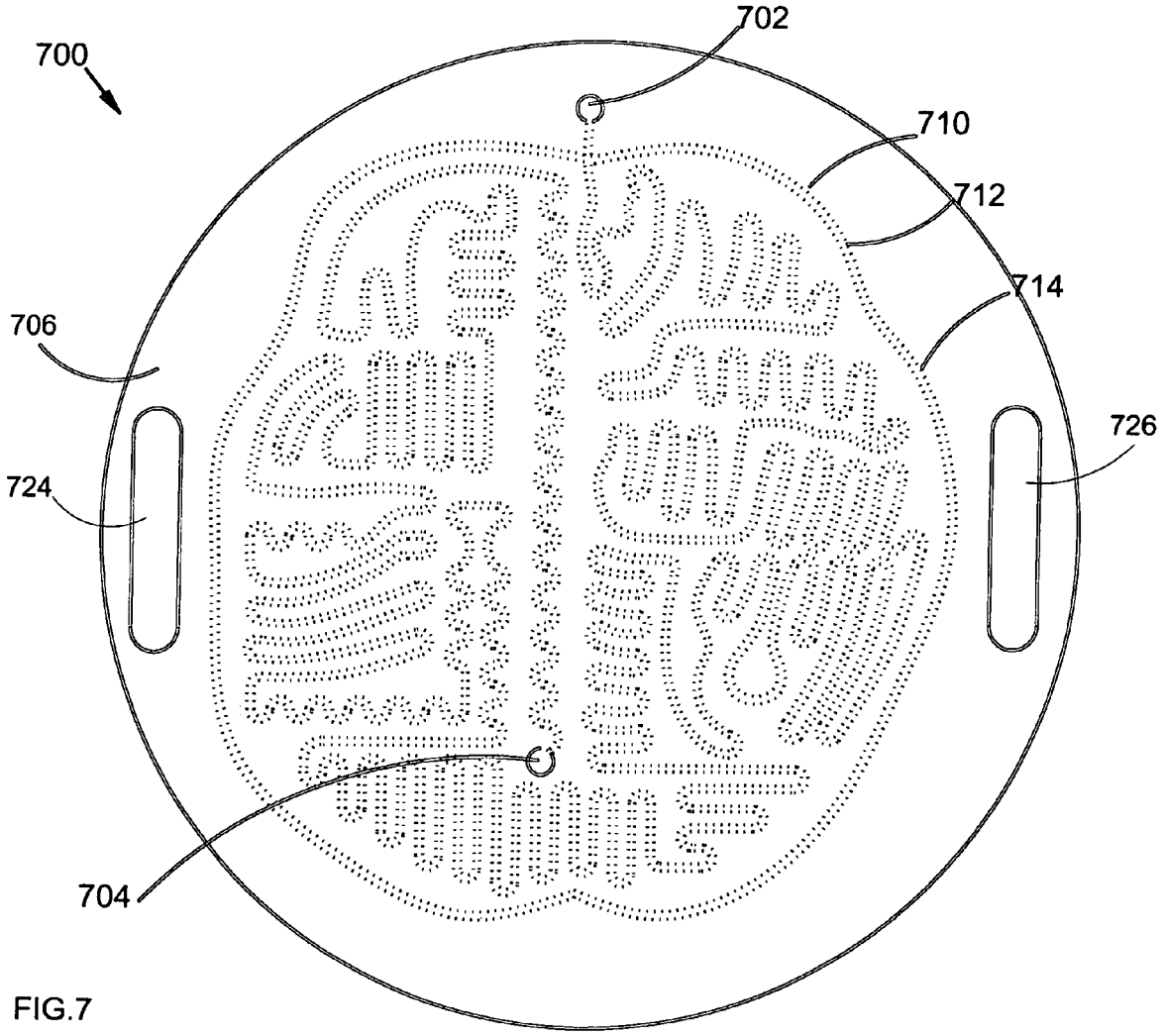
FIG. 7 is a plan view of an alternate pattern for use with a brainpath board in accordance with one embodiment of the present invention present invention wherein the sensory points are individual protrusions slightly spaced.

The disclosed network has taken the mechanism for tactile rewiring to the next level over prior art methods by using a tactile path designed to simultaneously contact both sides of the fingers. The tactile path forming the network can be either raised or indented in the material of manufacture depending upon manufacturing preferences. As the greatest benefit to the brainpath network is the dual contact vast number of mechanoreceptors located within the fingertips, it is critical that the spacing between the sides forming the tactile path be dimensioned so each side of the finger is contacted by the tactile path. In order to obtain optimal sensory feedback, the sides of the tactile path should have some level of sharpness, although not enough to injure the user. The sharpness to the tactile path can be continuous along the path, such as illustrated in FIGS. 2 and 3 or can be intermittent along the path as illustrated in FIG. 7. Although the sharp feel provides better stimulation to the brain, curved, or otherwise non-sharp, edges can also be used.

The brainpath network can be any design and length of path that provides the optimal stimulation based upon the situation. For example, a labyrinth or spiral may have one path to the center, or endpoint, and provides relaxed repetition. The repeated relaxation of the mind enhances the user's ability to concentrate and focus. The maze, however, is more challenging in that the user must find the correct path to reach the end. The mazes can be designed to increasingly more difficult to provide greater challenge to the user. In a complete, progressive stimulation system, the user would start with a simpler pathway pattern, such as a labyrinth or spiral and progress to the mazes which, in turn, may get increasingly difficult. A maze requires more focus than the simpler designs and may be frustrating for some.

Any of the pathway patterns can be performed with the eyes open or closed, and with or without music. The repetition time would vary depending upon the age and reason for use (brain organization, relaxation, etc.) and may be 15 minutes or more. As there is not detriment to use, time periods may often be left to the user. When used therapeutically, the therapist, clinician or doctor may recommend a minimum use time.

FIG. 1 illustrates an example brainpath board 100 in accordance with one embodiment of the present invention. In this example, a start 102 leads to a divergent path point 110 where the user can either circle the outside of a pathway pattern 140 along exterior path 122 or enter pathway pattern 140 at entry path 112. Once the user accesses the entry path 112, the tactile path 120 is followed through out the network until the end 104 is reached.

The network paths 110, 112, 120 and 122, as well as start 102 and end 104, can be either etched into or extend above the base 114, depending upon the manufacturing method. In the brainpath board 100, a handle 116 has been placed in the base 114 however this is an option and is not a requirement for the usability of the brainpath board 100.

The material of manufacture in all embodiments can be rigid, or semi rigid, plastic, composites or metals. Plastics provide numerous benefits, such as weight, the ability to add color and ease of manufacture. In some applications, such as a public wall, metal or composites may provide the added benefit of extreme durability to use and elements.

FIG. 2 is a side view of a raised sharp tactile path 202 that is formed by walls 204 and 212 extending up from base 220. In this embodiment, the walls 204 and 212 have angled top surfaces 206 and 214 to form sensory edges 208 and 216. Although sensory edges 208 and 216 provide the "sharp" feel to the network path, it must be reiterated that sensory edges 208 and 216 cannot harm the skin of the user.

The distance between the sensory edges 208 and 216 is about ⅛ inch to ⅜ inch wide; however variations in those distances to accommodate the end user will be evident to those skilled in the art in light of this disclosure. It should be noted, however that a fingertip has more than 3000 touch receptors and paths that are designed to touch the maximum number of receptors will achieve maximum results.

In FIG. 3, tactile path 302 has been etched, carved or molded into base 320. The edge created by the junction between tactile path 302 and base 320 forms sensory edges 304 and 306. If preferred, sensory edges 304 and 306 can be slightly curved to reduce the sharpness of the contact. As noted heretofore, the distance between sensory edges 304 and 306 should be about 0.125 inch to about 0.375 inch.

Figure 4:
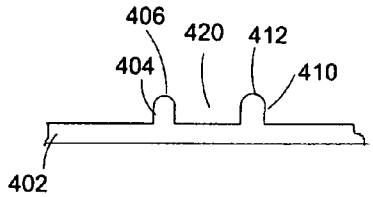
FIG. 4 is a cross-sectional view of rounded protrusions to for the path in accordance with one embodiment of the present invention present invention.

In embodiments where the sharp feel to the sensory edges is not preferable, a design such as illustrated in FIG. 4 can be used. In FIG. 4, base 402 has sensory extensions 404 and 410 extending at approximately right angles from base 402. The sensory extensions 404 and 410 form tactile path 420 which, as stated heretofore, has a width of about ⅛ inch to about ⅜ inch. The ends 406 and 412 of sensory extensions 404 and 410 are rounded and therefore provide a softer feel to the fingertips than the sharp paths illustrated in FIGS. 2 and 3.

Figure 5:
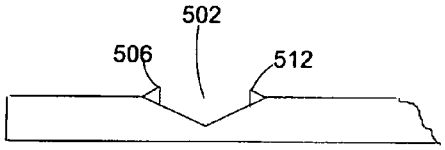
FIG. 5 is a cross-sectional side view of an alternate tactile path wherein the path is provided with teeth that provide tactile stimulation in accordance with one embodiment of the present invention present invention.

An alternate method of providing a sharp feel to the tactile path is illustrated in FIG. 5 wherein tactile path 502 is recessed into the base and has intermittent tetrahedrons 506 and 512 along its length. The tetrahedrons 506 and 512 are spaced from one another a sufficient amount to provide distinction between tetrahedrons 506 and 512 but not so far as to provide any point without contact between tetrahedrons 506 and 512 and a user's skin. In this illustration, the tetrahedrons 506 and 512 are angled from the surface of the base 502, however the tetrahedrons 506 and 512 may also be placed on the same plane as the surface of the base.

Figure 6:
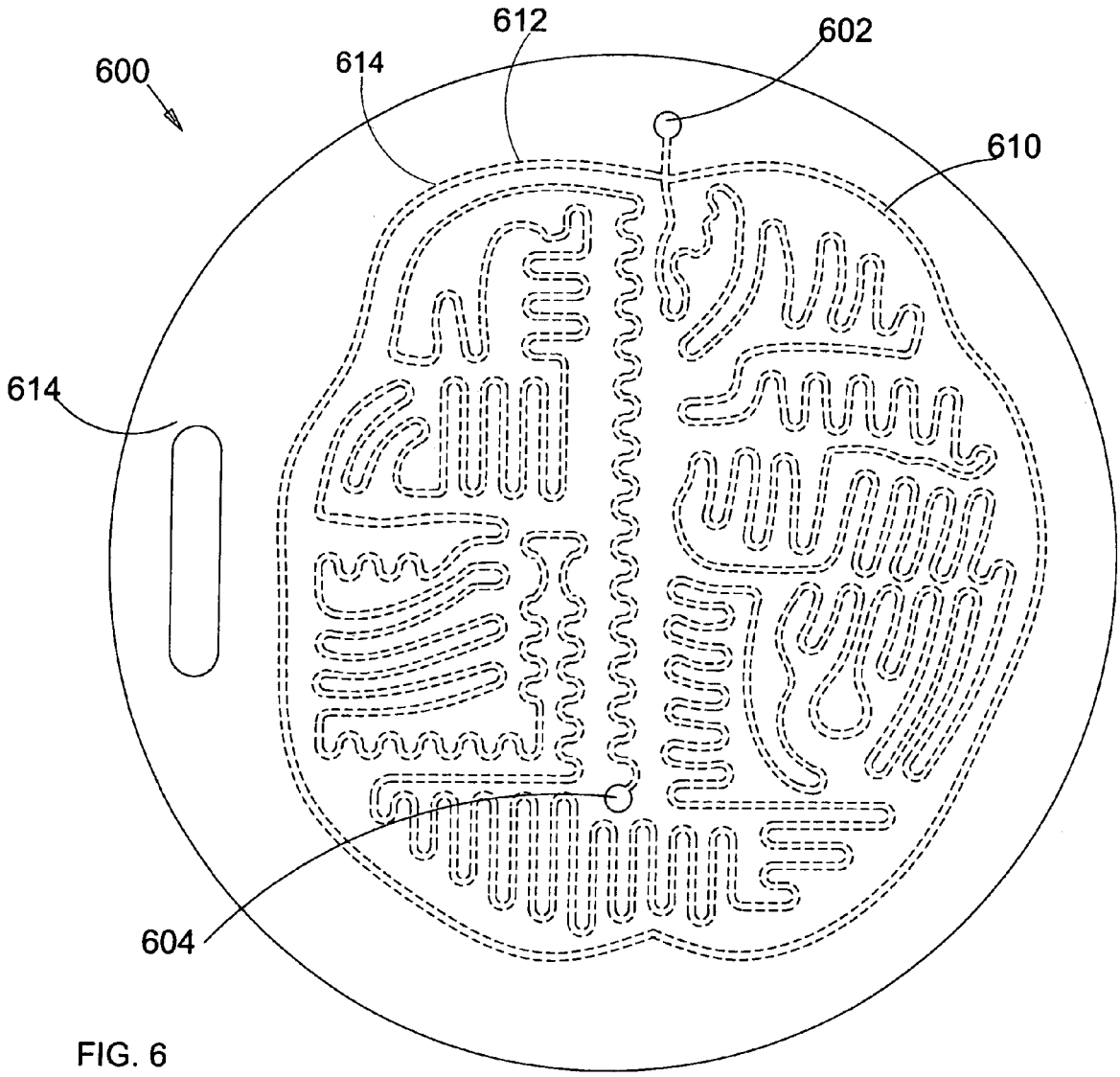
FIG. 6 is a plan view of an additional pattern for use with a brainpath board in accordance with one embodiment of the present invention present invention wherein the sensory points along the path are intermittent.

In FIG. 6 an alternate embodiment of the invention is illustrated wherein brainpath board 600 is a pathway pattern 620 with tactile path 610 having intermittent contact points.

The user, as with other embodiments, commences tactile path 610 at start 602 and continues until the pathway pattern 620 is finished at end 604. In this embodiment start 602 and end 604 are solid circles in order to differentiate them from the tactile path 610. In the pathway pattern 620, contact points 612 and spacing 614 are uniform in length; however both contact points 612 and spacing 614 can be varied throughout, as illustrated hereinafter, with the variations depending upon the desired pattern. Alternatively, a mixture of uniform and non-uniform spacing 614 and contact points can be used with either uniform or non-uniform as the dominate pattern. In this embodiment, contact points 612 are raised from base plate 614; however contact points 612 could also be designed in accordance with the aforementioned FIG. 5. When contact points 612 are intermittent, spacing 614 must be small enough that the user does not lose track of the next contact point 612. As with all embodiments, brainpath networks may require appropriate dimensioning based upon the end user.

In FIG. 7, the tactile path 710 of the brainpath board 700 is formed by pairs of small protrusions 712 from the base 706 which separated from one another by spacing 714. The protrusions 712 can be rounded, as used in Braille, square, triangular or any other geometric shape that may provide the appropriate stimulation to the fingertips. As discussed heretofore, the configuration of the tactile stimulation elements must not in any way abrade the skin of the user. The start 702 and end 704 are solid in this illustration, however start 702 and end 704 may also be formed by small protrusions 712. In this embodiment, dual handles 724 and 726 are placed on either side of the brainpath board 700.

Figure 8:
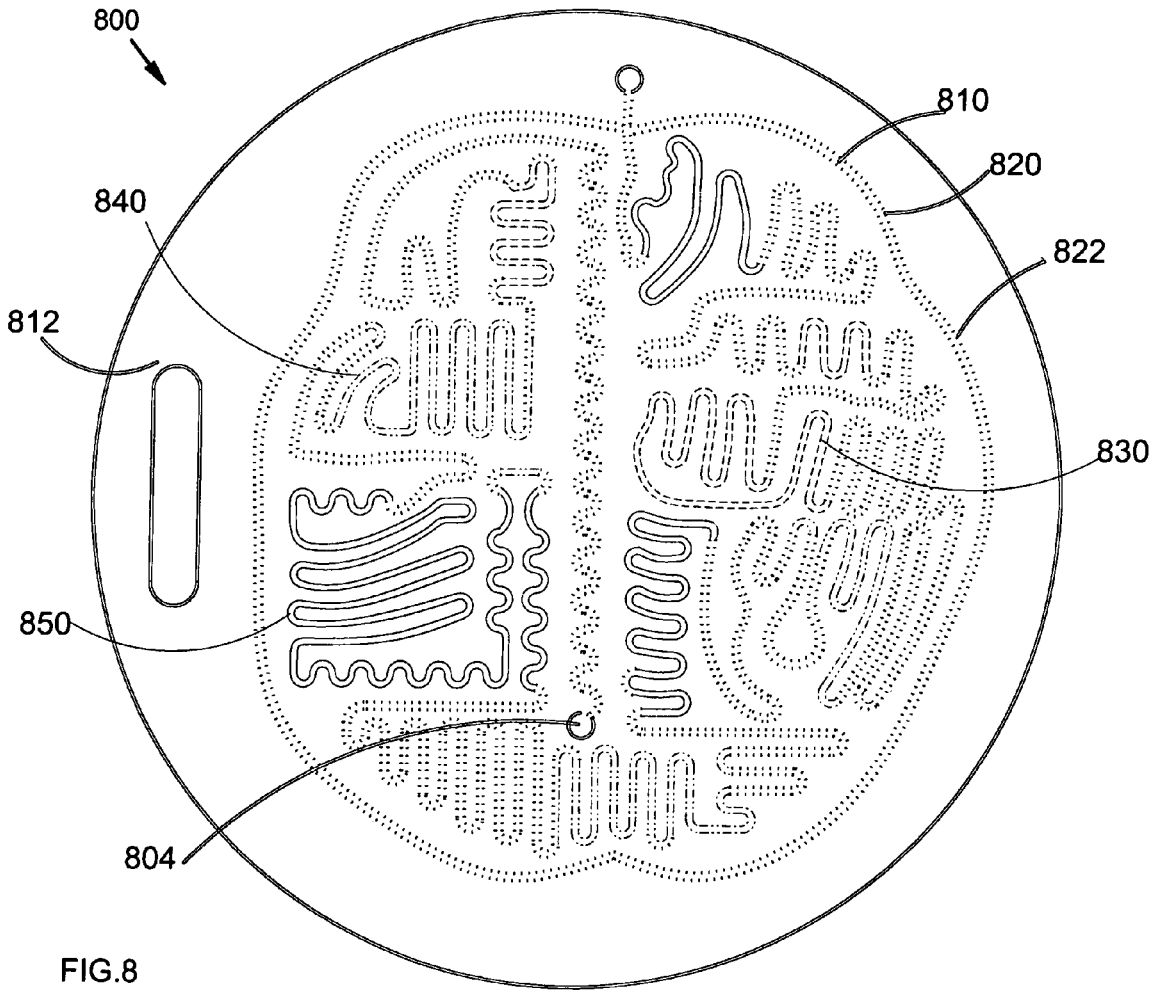
FIG. 8 is a plan view of another pattern wherein multiple textures of sensory points are mixed on a single brainpath board in accordance with one embodiment of the present invention present invention.

In FIG. 8, the brainpath board 800 uses a combination of textures in the tactile paths 810 to provide a varied stimulation. As can be seen in the example, paths 810 formed by small protrusions 820, separated by spacing 822, is the dominate configuration, although the different textures can be evenly dispersed. Evenly spaced intermittent contact points 830, as well as unevenly spaced intermittent contact points 840 and continuous tactile path 850 are used to vary the tactile sensation. Alternatively, side of the path can be solid while the other side of the path can be protrusions, with the combination staying consistent throughout the pattern or alternating.

Figure 9:
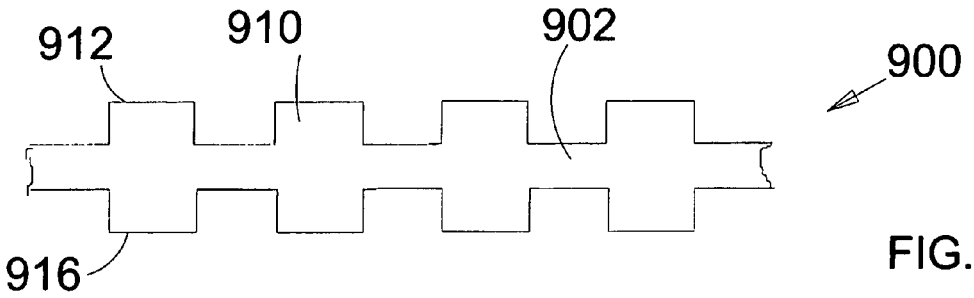
FIG. 9 is plan view of a section a recessed intermittent path in accordance with one embodiment of the present invention present invention.
Figure 10:
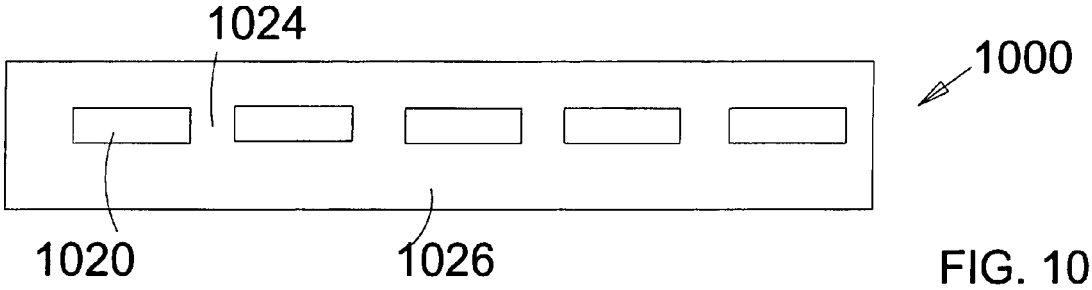
FIG. 10 is plan view of another example of a recessed intermittent path in accordance with one embodiment of the present invention present invention.
Figure 11:
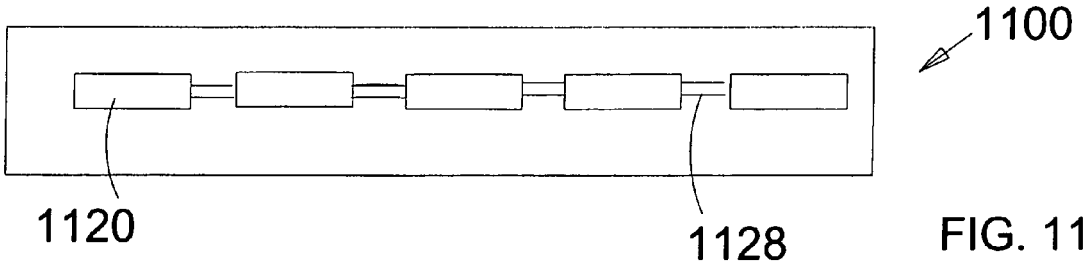
FIG. 11 is plan view of yet another example of a recessed intermittent path in accordance with one embodiment of the present invention present invention.

When the etched path 302 is used for an intermittent path, the variation may be either a widening of the path 900 or 1000, as illustrated in FIGS. 9 and 10, or an elimination of the path 1100 as illustrated in FIG. 11.

In FIG. 9, the tactile path 900 has contact points 902 and non-contact points 910, which are achieved by widening path 900. For example, contact points 902 would remain in the about 0.125 inch to 0.375 inch wide range while non-contact points 910 would be widened to about 0.75 inch or more, depending upon the end user. Although the contact points 902 and non-contact points 910 are illustrated in FIG. 9 as being rectangular in shape, any other shape can be used. It should also be noted that upper edge 912 and the lower edge 916 can be slightly offset.

In FIG. 10 the tactile path 1000 is formed by tactile square 1020 which are separated by filler area 1024 which is on the same plane as the base 1026. In FIG. 11 the tactile square 1120 is connected to the next tactile square 1120 by narrower channel 1128, thereby providing a varying "texture" to the tactile path 1000. The narrower channel 1128 still provides the dual contact with the fingertips. It should be noted that although rectangles are illustrated herein and referred to as tactile square 1020, any geometric shape can be used.

Figure 12:
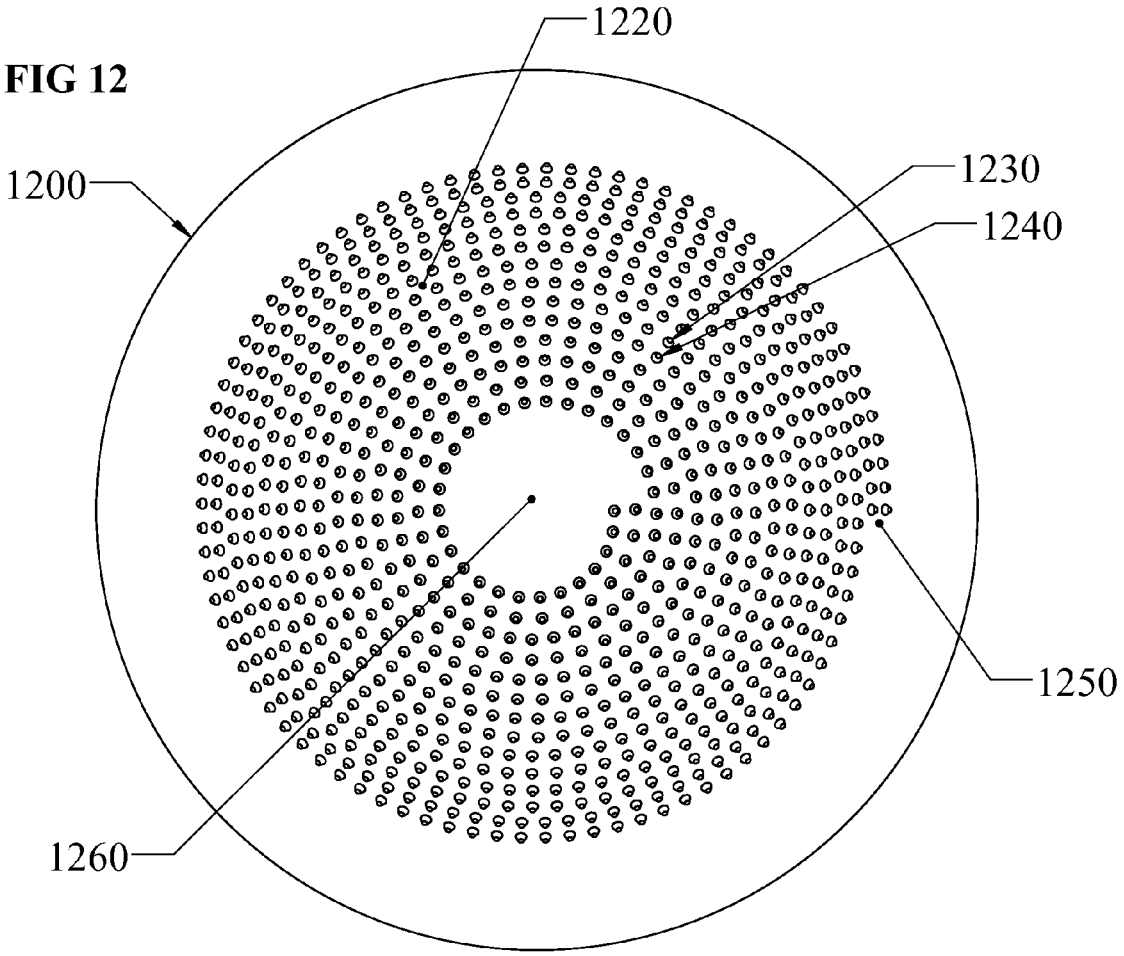
FIG. 12 is an embodiment of the present invention, baying a brainpath board with a flat shape and a network design of a spiral on the surface of the board.

FIG. 12 embodiment of the present invention is a brainpath board 1200 with a flat shape and a brainpath network in the shape of a spiral 1220 on the surface of the board. Spiral Network 1220 having an intermittent dual contact path as described in the specification and Abstract. Dual contact paths 1230 and 1240 are separated by a distance of about ⅛ inch to ⅜ inch, to touch mechanoreceptors under the skin of the fingertip. The tracing spiral has a beginning 1250 and an ending point 1260 in the center.

Figure 13:
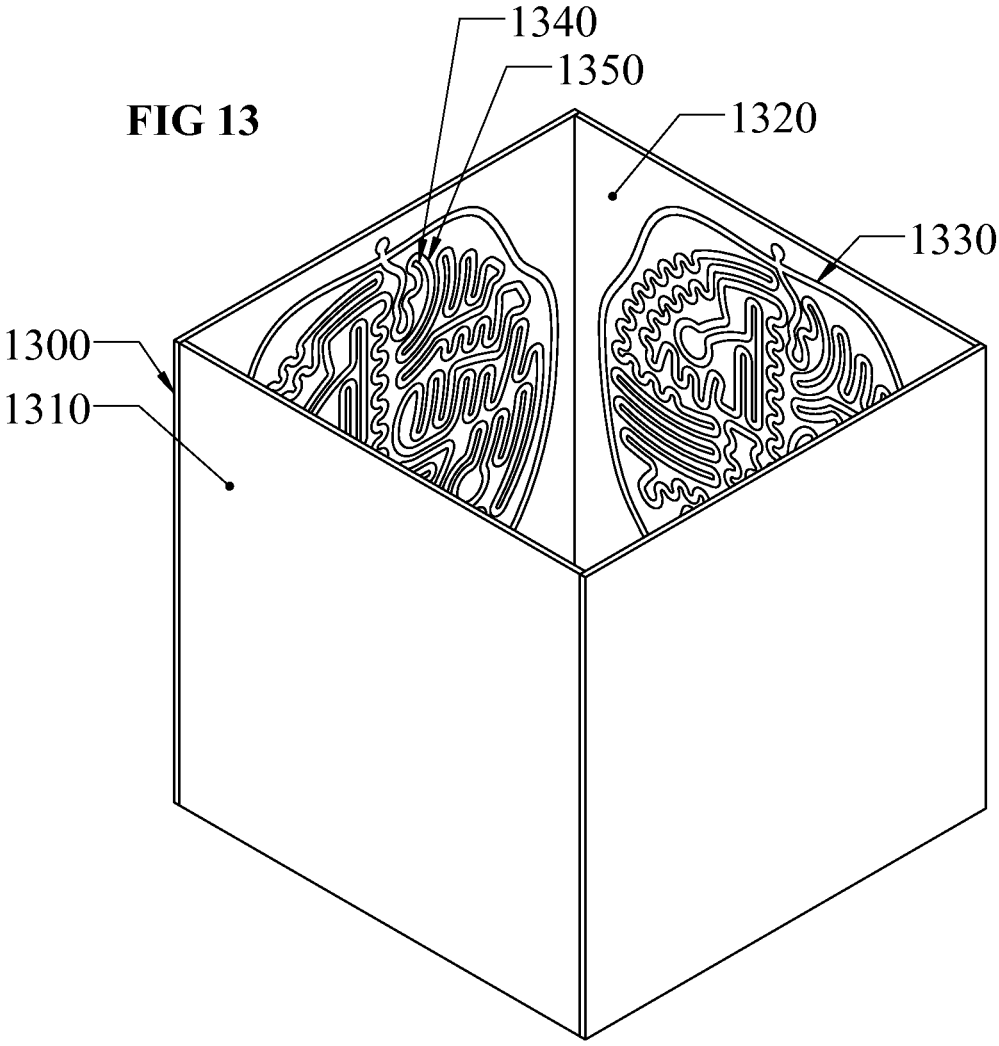
FIG. 13 is an embodiment of the present invention, having a brainpath board in the shape of a box and network designs on two surfaces of the board.

FIG. 13 embodiment of present invention is a brainpath board 1300 in the shape of a box having flat surfaces 1310 and 1320. Two or more accessible surfaces having networks of dual contact paths 1330 for tracing. The space between the dual contact paths 1340 and 1350, is separated by a distance of about ⅛ inch to ⅜ inch, to touch mechanoreceptors under the skin of the fingertip, as described in the invention.

Figure 14:
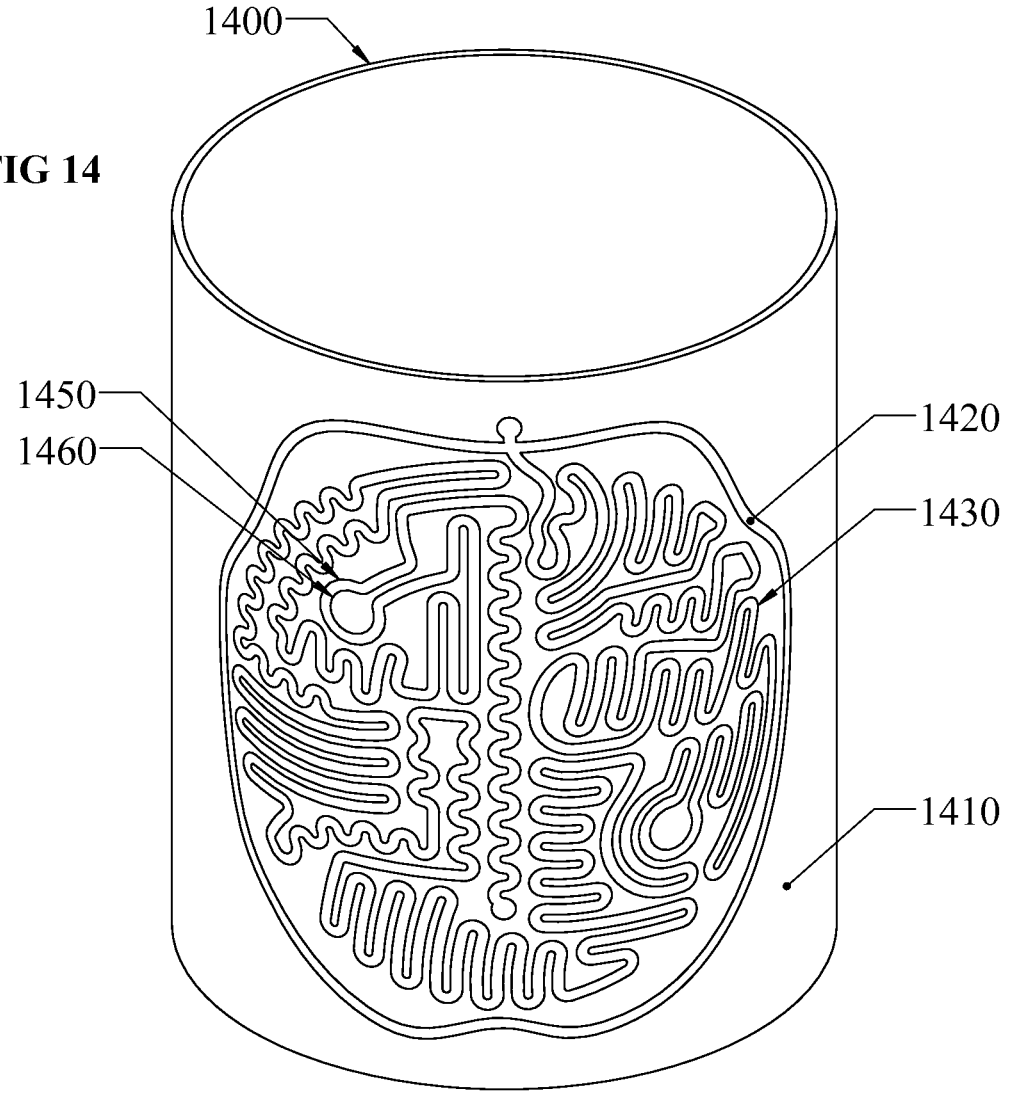
FIG. 14 is an embodiment of the present invention, having a brainpath board in the shape of a cylinder and a network design of a labyrinth on the surface of the board.

FIG. 14 embodiment of the present invention is a brainpath board shaped as a cylinder 1400 having an accessible surface 1410 for tracing by a user. The network design of the dual contact path on the surface of the board is a labyrinth 1430 as described in the specification. The space between the sides of dual contact 1450 and 1460 path is separated by a distance of about ⅛ inch to ⅜ inch, to touch mechanoreceptors under the skin of the fingertip, as described in the invention.

Figure 15:
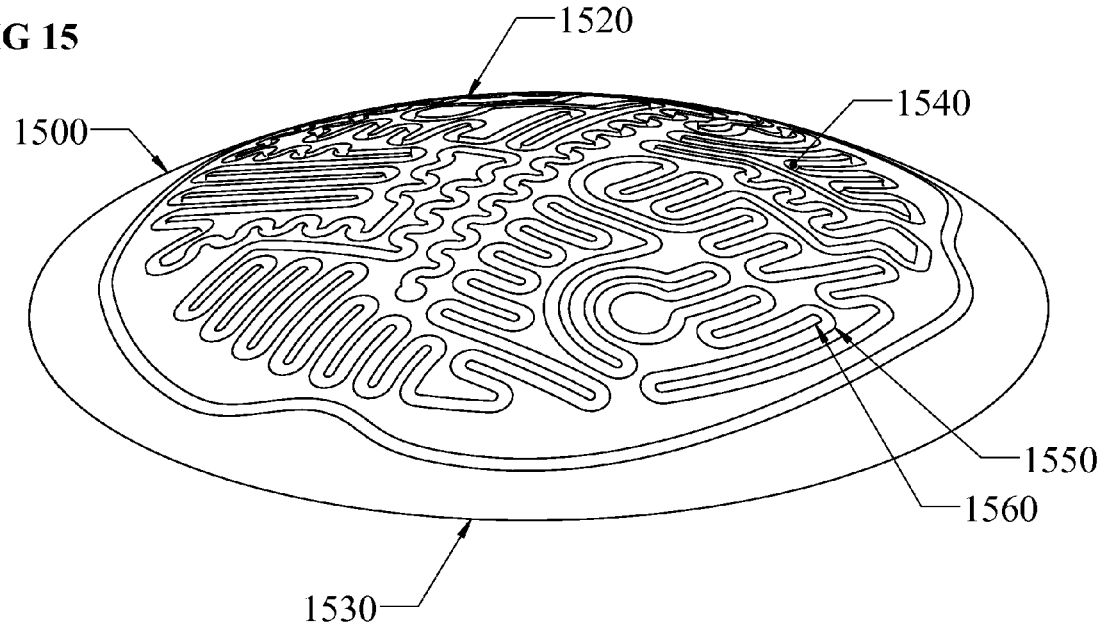
FIG. 15 is an embodiment of the present invention's brainpath board having a convex shaped surface.

FIG. 15 embodiment, a brainpath board has a convex surface 1500, the surface 1520 points to the outside of the board 1530; dual contact paths 1540 are separated by a space 1550 and 1560, having a distance of about ⅛ inch to ⅜ inch, to touch mechanoreceptors under the skin of each fingertip, as described in the invention.

Figure 16:
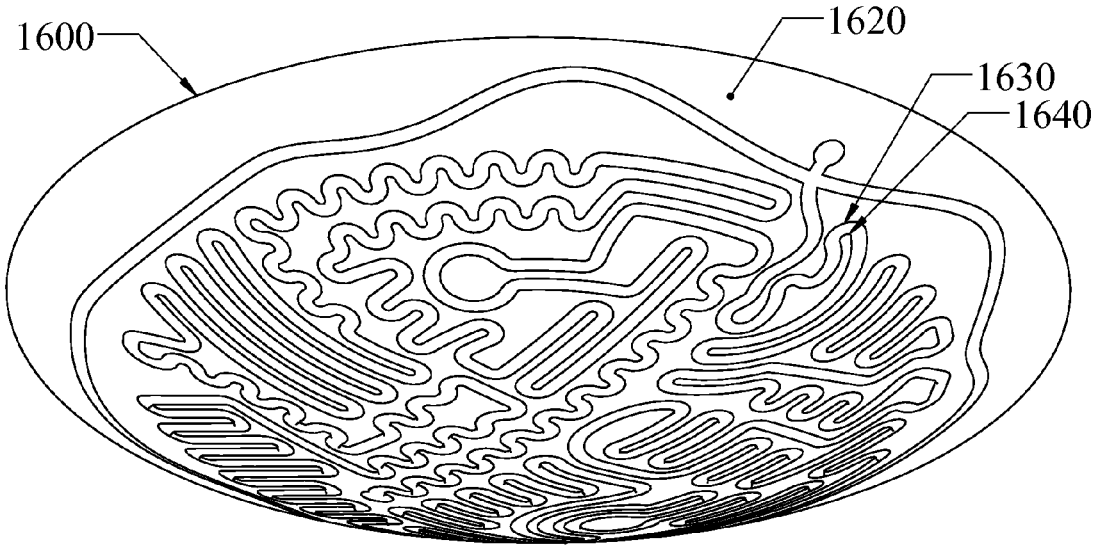
FIG. 16. is an embodiment of the present invention's brainpath board having a concave shaped surface.

FIG. 16 embodiment, a brainpath board 1600 has a concave surface 1620, pointing to the inside of the board, dual contact paths 1630 and 1640, are separated by a distance of about ⅛ inch to ⅜ inch, to roach mechanoreceptors under the skin of each fingertip, as described in the invention.

Figure 17:
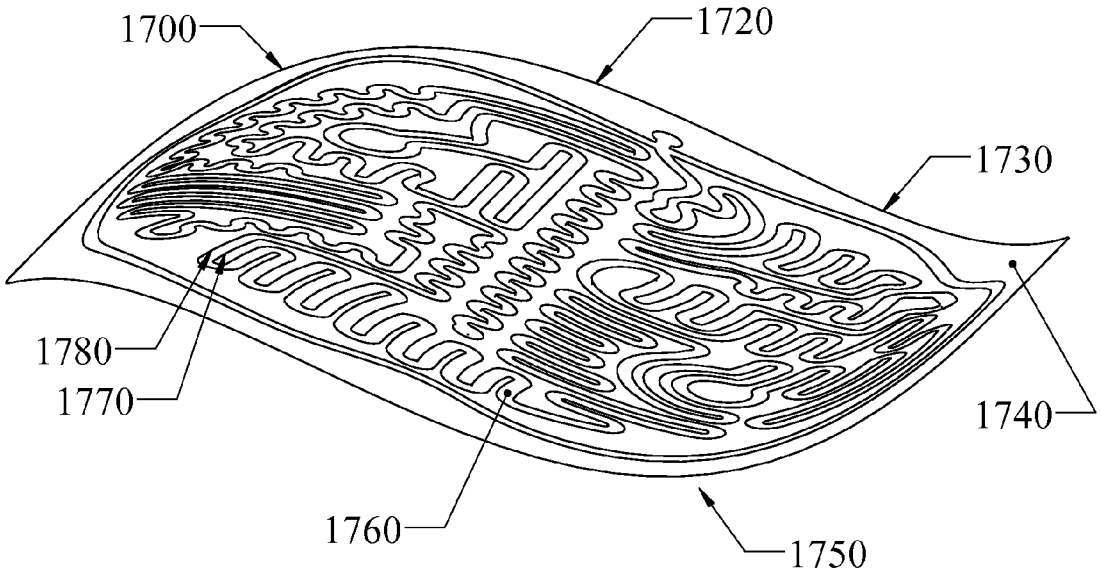
FIG. 17 is an embodiment of the present invention's brainpath board having an undulating shaped surface.

FIG. 17 illustrates an embodiment of a brainpath board in the shape of an undulating 1700 board, having wave-like or rippled form 1720 with a smooth, wavy appearance 1730, forming a surface with wavy smooth curves 1740; the curves having a gentle rising and falling of the waves 1750 on the accessible surface of the board. This view of an undulating brainpath board, having dual contact paths in the shape of a 1760 labyrinth; space between the dual contact paths 1770 and 1780, are separated by a distance of about ⅛ inch to ⅜ inch, touch mechanoreceptors under the skin of each fingertip as described in the invention.

Figure 18:
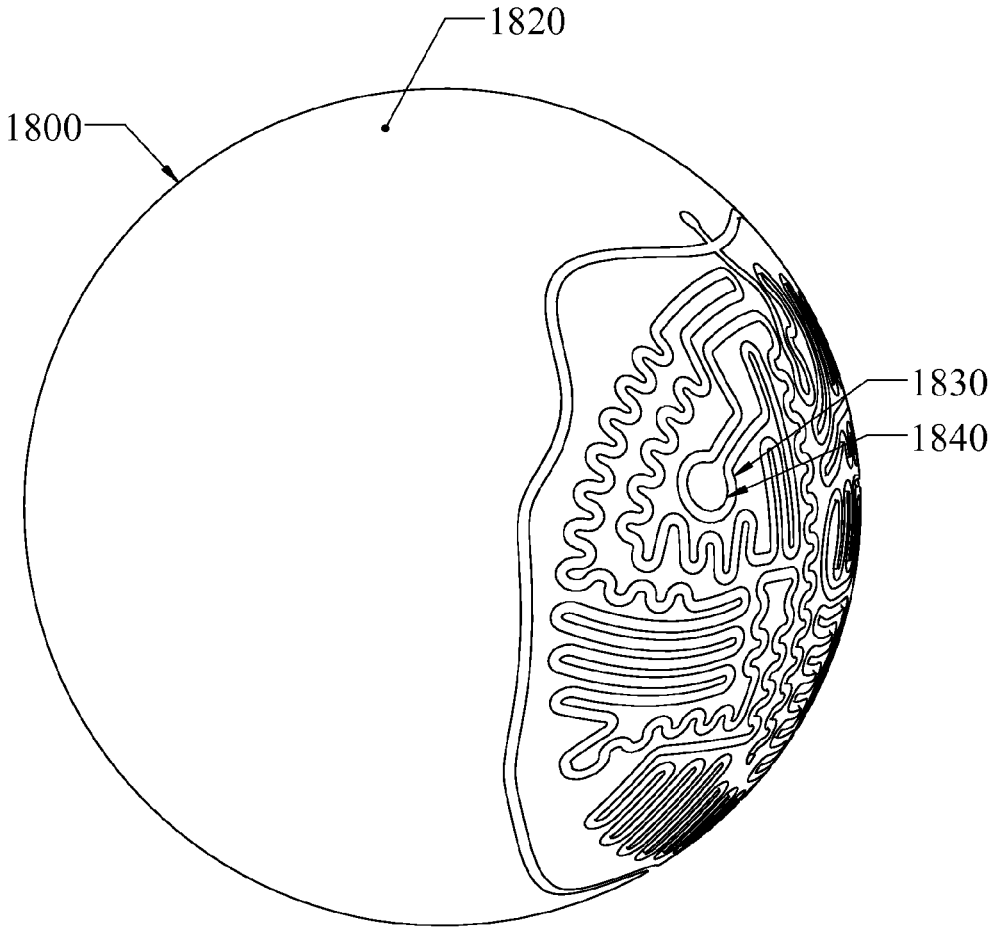
FIG. 18. is an embodiment of the present invention, having a brainpath board in the shape of a ball and a pathway pattern of networks of dual contact paths on the surface of the board.

FIG. 18 embodiment of the present invention is a brainpath board 1800 shaped as a ball 1820, having networks of dual contact paths designed as a labyrinth and a divergent path. The overall 'pathway pattern' of networks of dual contact pathways allows the user to trace network designs as the bail is rotated. Dual contact paths 1830 and 1840 are separated by a distance of about ⅛ inch to ⅜ inch, to touch mechanoreceptors under the skin of each fingertip, as described in the invention.

Any of the above embodiments can have cutouts for handles or raised areas for gripping; cutouts or hooks for hanging.

In one embodiment of the present a brainpath board of the present invention may be a molded plastic article that includes a pathway pattern. Various types of well-known moldable plastics may be used in making such a molded brainpath board.

In one embodiment, a larger brainpath board of the present invention may be made with legs (see Example II below) to be used as a free-standing table or without legs to allow the brainpath board to be mounted on a wall, such as a free standing wall, an exterior wall of a building, a wall of a room, etc.

In one embodiment, a brainpath board may be a box having an interior molded surface with a pathway pattern on one or more sides thereof. Such a box may be designed to prevent the user from seeing the pattern, so that the user must rely on the user's sense of touch alone to follow the pattern or solve the maze.

In one embodiment of the present invention, the brainpath board may be a ball having a pathway pattern on its surface. The ball may be placed on a table, on ground, etc., and the pathway pattern may be traced by the user as the ball is rotated.

EXAMPLES

Example I

A brainpath board similar to the board shown in FIG. 1 is made. The brainpath board may be held in a user's lap. The brainpath board is approximately 14 inches wide, 14 inches long and 0.375 inches thick. The brainpath board is constructed of durable plastic (one or two colors), and engraved with a groove having a width between 0.125 inch and 0.375 inch and a depth of about 0.125 inch.

Example II

A table size brainpath board is made that is 48 inches wide by 96 inches long. The brainpath board is provided with legs for use in large community rooms or playgrounds. The table sized brainpath board may be accessed by walking around the board and can contain one or more independent patterns.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

The invention claimed is:

1. A fingertip tracing device for repetitive fingertip movement to touch mechanoreceptors under a skin of a fingertip, to stimulate a brain, comprising:

a brainpath board having a shape and a surface with one or more networks of dual contact paths configured on one or more sides of the board;

each of the one or more networks of dual contact paths having an overall design formed by one dual contact path; the dual contact path having a first side edge and a second side edge, the first and second side edges of the dual contact path are spaced apart by an intervening space of about ⅛-⅜ of an inch; the first and second side edges are configured to be touched by two sides of a user's fingertip while tracing the dual contact path;

the one or more networks of dual contact paths are configured on one side of the brainpath board and are comprised of a mixture of solid continuous dual contact path sections that are recessed into the surface of the brainpath board and intermittent dual contact path sections protruding above the surface of the brainpath board;

wherein first and second side edges of the intermittent dual contact path section are configured so that a spacing between subsequent side edges of the intermittent dual contact path sections protruding from the brainpath board is adapted to allow the fingertip of a user to not lose track of contact points while tracing the intermittent dual contact path sections; each of the first and second side edges of the intermittent dual contact path sections are formed of individual protrusions;

the mixture of dual contact paths further comprise networks of dual contact paths having sharp edges, configured to not abrade the user;

the brainpath board is constructed of light-weight molded plastic for ensuring user-safety for all ages of users and is configured to rest on a user's lap;

the networks of dual contact paths are designed to enable a maximum number of receptors under the fingertip of the user to be touched and the length of path provides stimulation to the fingertips.

2. The fingertip tracing device of claim 1, wherein the brainpath board additionally comprises a continuous network dual contact path recessing into the surface of the board in the shape of a spiral on one or more sides of the brainpath board.

3. The fingertip tracing device of claim 1, wherein the brainpath board additionally comprises an intermittent network dual contact path protruding above the surface in the shape of a spiral on one or more sides of the brainpath board.

4. The fingertip tracing device of claim 1, wherein the shape of the brainpath board is flat and the surface of the brainpath board is flat.

5. The fingertip tracing device of claim 1, wherein the shape of the brainpath board is a ball.

6. The fingertip tracing device of claim 1, wherein the shape of the brainpath board is a box.

7. The fingertip tracing device of claim 1, wherein the shape of the brainpath board is a cylinder.

8. The fingertip tracing device of claim 1, wherein the surface of the brainpath board is concave.

9. The fingertip tracing device of claim 1, wherein the surface of the brainpath board is convex.

10. The fingertip tracing device of claim 1, wherein the surface of the brainpath board is undulating.

11. The fingertip tracing device of claim 1, wherein the design of the one or more networks of dual contact paths is a maze; wherein the maze has a design configured for the user to trace the correct path to reach the end of the maze.

12. The fingertip tracing device of claim 1, wherein the design of the one or more networks of dual contact paths is a labyrinth.

13. The fingertip tracing device of claim 1, wherein the one or more networks of dual contact paths additionally comprises the design of a spiral.

14. The fingertip tracing device of claim 1, wherein the brainpath board additionally has a divergent path configured to allow the user to trace a circle of an outside pathway pattern along an exterior path, or to allow the user to trace the pathway pattern at an entry path to trace an interior pathway designed as a labyrinth.

15. The fingertip tracing device of claim 1, wherein the brainpath board additionally comprises:

dual contact paths formed by intermittent spaced protrusions separated by evenly dispersed spacing, dual contact paths formed by intermittent spaced protrusions separated by unevenly dispersed spacing, dual contact paths having continuous contact points, dual contact paths having one side provided with continuous contact points and the other side provided with intermittent spaced protrusions, to vary the tactile sensation.

* * * * *